United States Patent [19]

May et al.

[11] Patent Number: 4,998,139

[45] Date of Patent: Mar. 5, 1991

[54] ADAPTIVE BIAS CONTROL FOR TRI-LEVEL XEROGRAPHY

[75] Inventors: Jerome E. May; Delmer G. Parker, both of Rochester; Howard M. Stark, Webster, all of N.Y.

[73] Assignee: Xerox Corporation, Stamford, Conn.

[21] Appl. No.: 335,344

[22] Filed: Apr. 10, 1989

[51] Int. Cl.[5] ..... G03G 15/01; G03G 15/08

[52] U.S. Cl. ..... 355/208; 355/246; 355/328; 430/45; 430/122

[58] Field of Search ..... 355/208, 214, 216, 217, 355/228, 328, 246; 430/30, 31, 42, 45

[56] References Cited

U.S. PATENT DOCUMENTS 4,078,929 3/1978 Gundlach ..... 430/42
4,272,182 6/1981 Abe et al. ..... 355/246
4,771,314 9/1988 Parker et al. ..... 355/328
4,855,766 8/1989 Suzuki ..... 355/214 X

FOREIGN PATENT DOCUMENTS 59-133564 .7/1984 Japan ..... 355/214
63-296062 12/1988 Japan ..... 355/216

*Primary Examiner*—Joan H. Pendegrass

[57] ABSTRACT

In a tri-level imaging apparatus, a development control arrangement wherein the white discharge level is stabilized at a predetermined voltage and the bias voltages for the developer housings for charged area and discharged area development are independently adjustable for maintaining image background levels within acceptable limits. The white discharge level can be shifted to preferentially enhance the copy quality of one or the other of the charged area or discharged area images.

12 Claims, 2 Drawing Sheets

ADAPTIVE BIAS CONTROL FOR TRI-LEVEL XEROGRAPHY

CROSS-REFERENCE

Pat. application D/86202, entitled White "Level Stabilization For Tri-Level Imaging", filed in the name of May et al in the USPTO on or about the same date as the present application and assigned to the same assignee as the instant invention.

BACKGROUND OF THE INVENTION

This invention relates generally to tri-level, highlight color imaging and more particularly to an adaptive bias control arrangement which compensates for developer and photoreceptor aging.

In the practice of conventional xerography, it is the general procedure to form electrosatic latent images on a charge retentive surface such as photoconductive member by first uniformly charging the charge retentive surface. The charged area is selectively dissipated in accordance with a pattern of activating radiation corresponding to original images. The selective dissipation of the charge leaves a latent charge pattern on the imaging surface corresponding to the areas not exposed by radiation.

THis charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, not only are the charged (i.e., unexposed) areas developed with toner but the discharged (i.e., fully exposed) images are also developed. Thus, the charge retentive surface contains three voltage levels which correspond to two image areas and to a background voltage area. One of the image areas corresponds to non-exposed (i.e. charged) areas of the photoreceptor, as in the case of conventional xerography, while the other image areas correspond to fully exposed (i.e., discharged) areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. (CAD) remains at or near the fully charged photoreceptor potential represented by $V_{cad}$ or $V_{ddp}$ as shown in FIG. 1*a*. The other images are formed by discharging the photoreceptor to its residual potential, i.e. $V_{dad}$ or $V_c$ (typically 100 v) which corresponds to discharged area images that are subsequently developed by discharged-area development (DAD). The background areas are formed by discharging the photoreceptor to reduce its potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ is to $V_{cad}$, resulting in a $V_{bb}$ of about 600 volts, and the DAD developer system is biased about 100 V ($V_{cb}$, shown in FIG. 1*b*) closer to $V_{dad}$ than $V_{white}$ is to $V_{dad}$ resulting in a $V_{cb}$ of about 400 volts.

As developed, the composite tri-level image initially consists of both positive and negative toners. To enable conventional corona transfer, it is necessary to first convert the entire image to the same polarity. This must be done without overcharging the toner that already has the correct polarity for transfer. If the amount of charge on the toner becomes excessive, normal transfer will be impaired and the coulomb forces may cause toner disturbances in the developed image. On the other hand, if the toner whose polarity is being reversed is not charged sufficiently its transfer efficiency will be poor and the transferred image will be unsatisfactory.

BRIEF SUMMARY OF THE INVENTION

As toner charge decreases with age, larger cleaning fields are required to prevent unwanted background development. A cleaning field is the difference between the white level voltage and a developer bias voltage. In tri-level imaging, the cleaning fields are approximately equal to 100 volts.

In accordance with one aspect of the invention, the developer biases are adjusted to increase the magnitudes of the cleaning fields as the toner charge decreases. In other words, the difference between the white level voltage and the developer biases is increased. To this end, the developed density of a low voltage test patch is periodically sensed to generate electrical signals which are used for controlling the adjustment of the developer biases.

As the photoreceptor ages or deteriorates, the white level of a tri-level image becomes noisy or starts to vary spatially (i.e. vary about 50 volts). This results in a local decrease in the cleaning field strength. It is necessary to maintain a 100 volt differential between the developer biases and the white level in order to maintain proper cleaning field strength. This is accomplished, in accordance with another aspect of the invention, by monitoring the white level voltage and increasing the difference between the white level and the developer housing bias in response to the sensing of such noise. Such increase in cleaning field strength obviously results in a loss in development field strength and consequently, developed image density. The loss is less significant than control of background development.

Normally, tri-level images of equal copy quality are formed. Thus, the white discharge level is maintained at a level equal to half the difference in the bias voltages. However, there are times when it may be desirable to maintain the copy quality of one ri-level image at the sacrifice of the other. For, example, color images of poorer quality might be preferably to black images of poorer quality.

In accordance with still another aspect of the invention, the copy quality of the black images are maintained at the expense of the color images by preferentially shifting the white level toward the level of the color bias resulting in a larger cleaning field for the black developer housing and a smaller cleaning field for the color developer housing.

DETAILED DESCRIPTION OF THE PREFERRED EMBODIMENT OF THE INVENTION

Figure 2:
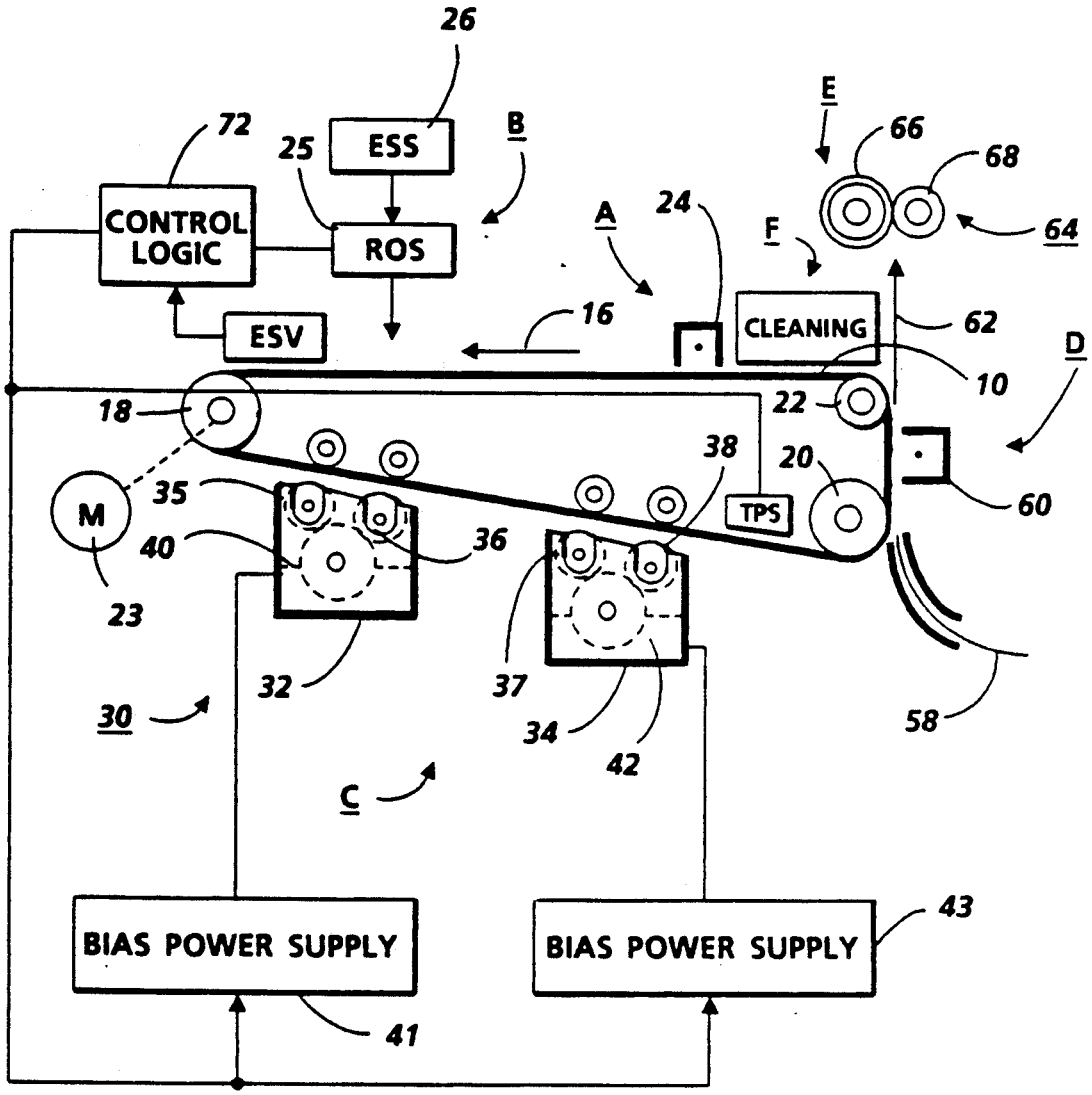
FIG. 2 is a schematic illustration of a printing apparatus incorporating the inventive features of the invention.

As shown in FIG. 2, a printing machine incorporating the invention may utilize a charge retentive member in the form of a photoconductive belt 10 consisting of a photoconductive surface and an electrically conductive, light transmissive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_O$. Any suitable control, well known in the art, may be employed for controlling the corona discharge device 24.

Figure 1A:
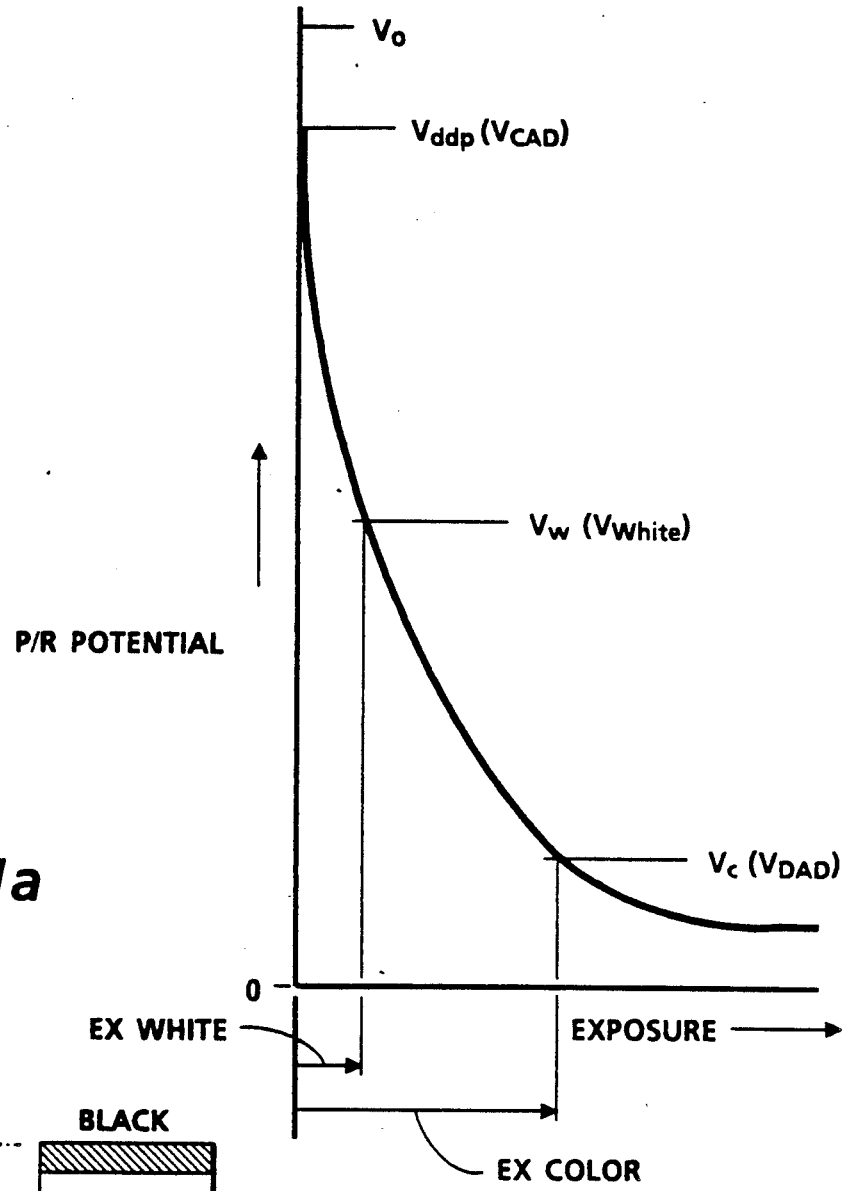
FIG. 1*a* is a plot of photoreceptor potential versus exposure illustrating a tri-level electrostatic latent image.
Figure 1B:
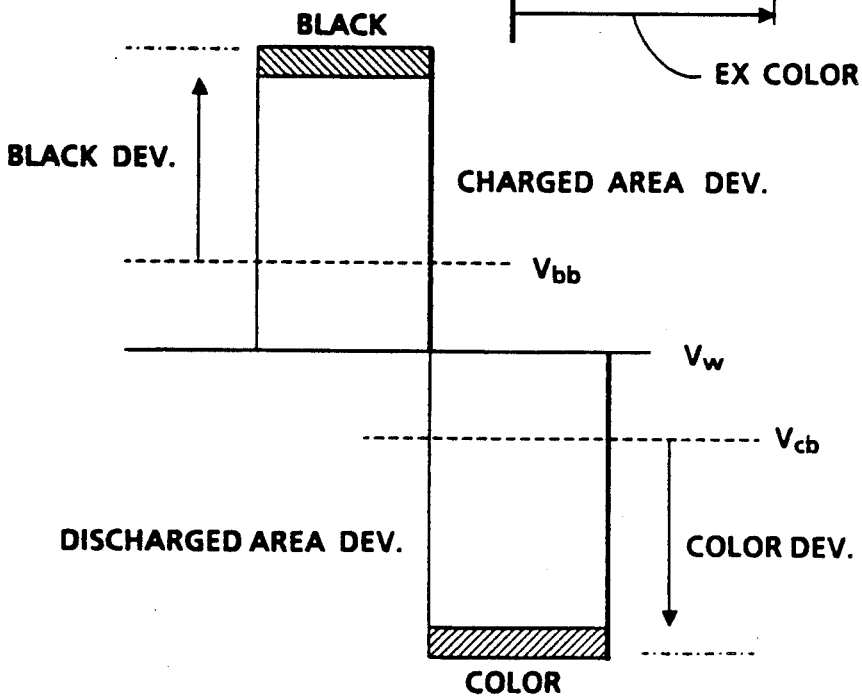
FIG. 1*b* is a plot of photoreceptor potential illustrating single-pass, highlight color latent image characteristics.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three-level laser Raster Output Scanner (ROS). An Electronic SubSystem (ESS) 26 converts a previously stored image into the appropriate control signals for the ROS in an imagewise fashion. The resulting photoreceptor contains both charged-area (CAD) images and discharged-area images (DAD) as well as background areas designated as $V_w$ in FIGS. 1*a* and 1*b*.

The photoreceptor, which is initially charged to a voltage $V_O$, undergoes dark decay to a level $V_{ddp}$ ($V_{cad}$) equal to about −900 volts. When exposed at the exposure station B it is discharged to $V_c$, ($V_{dad}$) equal to about −100 volts in the highlight (i.e. color other than black) color parts of the image. See FIG. 1*a*. The photoreceptor is also discharged to $V_w$ ($V_{white}$) equal to −500 volts imagewise in the background (white) image areas and in the inter-document area. After passing through the exposure station, the photoreceptor contains charged areas and discharged areas which corresponding to CAD and DAD latent images.

At development station C, a development system, indicated generally by the reference numeral 30 advances developer materials into contact with the CAD and DAD electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the charged-area images. The developer material 40 by way of example contains positively charged black toner mixed with carrier beads which are preferably conductive. Electrical biasing is accomplished via power supply 41 electrically connected to developer apparatus 32. A DC bias of approximately −600 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the discharged-area images. The developer material 42 by way of example contains negatively charged red toner for developing the discharged-area images. The red developer, like the black developer, is preferably conductive. Appropriate electrical biasing is accomplished via power supply 43 electrically connected to developer apparatus 34. A suitable DC bias of approximately −400 volts is applied to the rollers 37 and 38 via the bias power supply 43.

Because the composite image developed on the photoreceptor consists of both positive and negative toner, a typically positive pre-transfer corona discharge member (not shown) is provided to condition the toner for effective transfer to a substrate using positive corona discharge. The pre-transfer corona discharge member is preferably an ac corona device biased with a dc voltage to operate in a field sensitive mode and to perform tri-level xerography pre-transfer charging in a way that selectively adds more charge (or at least comparable charge) to the part of composite tri-level image that must have its polarity reversed compared to elsewhere. This charge discrimination is enhanced by discharging the photoreceptor carrying the composite developed latent image with light before the pre-transfer charging begins. Furthermore, flooding the photoreceptor with light coincident with the pre-transfer charging minimizes the tendency to overcharge portions of the image which are already at the correct polarity.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Other cleaning systems, such as fur brush or blade, are also suitable.

Subsequent to cleaning, a discharge lamp (not shown) floods the photoconductive surface with light to dissipate any residual electrostatic charge remaining prior to the charging thereof for the successive imaging cycle.

Stabilization of the white or background discharge voltage level is accomplished by monitoring photoreceptor white discharge level in the inner-document area of the photoreceptor using an electrostatic voltmeter (ESV) 70. The information obtained thereby is utilized by control logic 72 to control the output of the raster output scanner 25 so as to maintain the white discharge level at a predetermined level.

The control logic 72 may comprise any well known element which provides a reference voltage representative of a predetermine white voltage level. The control logic compares the voltage value sensed by the ESV 70 to the predetermined value and generates a signal which is used to control the output of the ROS to thereby maintain the white discharge level at the predetermined level. Correction of the white level output of the raster output scanner is timed by the control logic such that correction is precluded from taking place within an image frame in order to avoid white level gradients in the image frame.

Normally, tri-level images of equal copy quality are created. Thus, the white discharge level is maintained at a level equal to half the difference between the bias voltage. However, there are times when it may be desirable to maintain the copy quality of one tri-level image at the sacrifice of the other. For, example, color images with poorer quality might be preferable to black images with poorer quality.

In accordance with one aspect of the invention, the copy quality of the black images are maintained at the expense of the color images by preferentially shifting the white level toward the level of the color bias. In other words $V_w$ is shifted toward $V_c$ resulting in a larger cleaning field for the black developer housing and a smaller cleaning field for the color developer housing. This is readily accomplished by the control logic 72.

In accordance with another aspect of the invention, the developer biases are adjusted to increase the magnitude of the cleaning fields in order to compensate for the effects of developer aging. As [toner ] developer ages, its charge decreases. When this occurs the cleaning field associated with a tri-level image becomes ineffective in preventing unwanted background development. A cleaning field (typically equally to 100 volts) is the difference between the white level voltage and a developer bias voltage. The developed density of a low voltage test patch developed on the photoreceptor is periodically sensed using a toner patch sensor 74 for generating electrical signals which are used of controlling the adjustment of the developer biases. Each developer bias is adjusted so that the difference between it and the white discharge level is increased from approximately 100 volts to approximately 150 volts thereby increasing the cleaning field to a level which is effective in preventing background development once the toner charge has diminished.

Developer bias adjustment is also utilized to compensate for photoreceptor aging. As the photoreceptor ages or deteriorates, the white level of a tri-level image becomes noisy or vary spatially (i.e. vary about 50 volts). This results in a local decrease in the cleaning field strength. It is necessary to maintain typically a 100 volt differential between each developer bias and the white level in order to maintain a proper cleaning field. This is accomplished, in accordance with another aspect of the invention, by monitoring the white level voltage and increasing the difference between the white level and developer housing bias in response to the sensing of such noise. Such increase in cleaning field strength obviously results in a loss in development field strength and consequently, developed image density. The loss is less significant than control of background development.

What is claimed is:

1. A method of creating tri-level, toner images on a charge retentive surface, said method including the steps of:

uniformly charging said charge retentive surface;

exposing said uniformly charged surface to form charged-area images, discharged-area images and white discharge level areas;

biasing a pair of developer housings to predetermined voltage levels for establishing suitable development fields between said developer housing and said charged-area and discharged-area images and cleaning fields between said developer housings and said white discharge level;

generating signals representative of the charge condition of said toner;

utilizing said signals for adjusting the bias levels on said developer housings to increase the magnitude of said cleaning fields in response to a decrease in the charge level of said toner.

2. The method according to claim 1 including the step of:

generating signals representative of said white discharge level and utilizing said signals to adjust the bias voltage levels on said developer housings in order to maintain at least one cleaning field at approximately 100 volts.

3. The method according to claim 2 including the step of utilizing the signals representative of said white discharge level for maintaining said white discharge level at a predetermined level.

4. The method according to claim 3 wherein said white discharge level is maintained at a level that is closer to the bias level on one of said developer housings than the bias level on the other of said developer housing biases.

5. The method according to claim 4 wherein said step of exposing comprises exposing said uniformly charged surface to a three-level raster output scanner to form tri-level images spaced apart by an inter-document white discharge level area.

6. The method according to claim 5 wherein the step of generating signals representative of said white discharge level comprises monitoring the inter-document white discharge level voltage level and generating an output signal representing said white discharge level voltage.

7. Apparatus for creating tri-level, toner images on a charge retentive surface, said method including the steps of:

means for uniformly charging said charge retentive surface;

means for exposing said uniformly charged surface to form charged-area images, discharged-area images and white discharge level areas;

means for biasing a pair of developer housings to predetermined voltage levels for establishing development fields between said developer housings and said charged-area and discharged-area images and cleaning fields between said developer housings and said white discharge level;

means for generating signals representative of the charge condition of said toner;

means for adjusting the bias levels on said developer housings to increase the magnitude of said cleaning fields in response to a decrease in the charge level of said toner.

8. Apparatus according to claim 7 including:

means for generating signals representative of said white discharge level adjusting the bias voltage levels on said developer housings in order to maintain at least one cleaning field at approximately 100 volts.

9. Apparatus according to claim 8 including means for maintaining said white discharge level at a predetermined level in response to the signals representative of said white discharge level for.

10. Apparatus according to claim 9 wherein said white discharge level is maintained at a level that is closer to the bias level on one of said developer housings than the bias level on the other of said developer housing biases.

11. Apparatus according to claim 10 wherein said exposing means comprises means for exposing said uniformly charged surface to a three-level raster output scanner to form tri-level images spaced apart by an inter-document white discharge level area.

12. Apparatus according to claim 11 wherein said means for generating signals representative of said white discharge level comprises means for monitoring the inter-document white discharge level voltage level and generating an output signal representing said white discharge level voltage.

* * * * *